US006009378A

United States Patent [19]

Tang et al.

[11] Patent Number: 6,009,378

[45] Date of Patent: Dec. 28, 1999

[54] METHOD OF APPLYING AN ANISOTROPIC HARDENING RULE OF PLASTICITY TO SHEET METAL FORMING PROCESSES

[75] Inventors: Sing Chih Tang, Plymouth; James Calvey Carnes, Willis, both of Mich.

[73] Assignee: Ford Global Technologies, Inc., Dearborn, Mich.

[21] Appl. No.: 08/950,085

[22] Filed: Oct. 14, 1997

[51] Int. Cl.[6] ..... G06F 17/00; B21D 5/00

[52] U.S. Cl. ..... 702/34; 702/42; 364/471.01; 364/472.01; 364/472.06

[58] Field of Search ..... 702/34, 41–42; 364/468.04, 471.04, 472.01, 472.06, 476.01

[56] References Cited

U.S. PATENT DOCUMENTS

| | | | |
|---|---|---|---|
| 3,816,211 | 6/1974 | Haigh | 156/309 |
| 4,621,523 | 11/1986 | Shabel et al. | 73/81 |
| 4,658,362 | 4/1987 | Bhatt | 364/472.01 |
| 5,168,169 | 12/1992 | Brew, Jr. et al. | 364/474.07 |
| 5,341,303 | 8/1994 | Foroudastan et al. | 364/468 |
| 5,379,227 | 1/1995 | Tang et al. | 364/468.04 |
| 5,390,127 | 2/1995 | Tang et al. | 364/472.02 |
| 5,463,558 | 10/1995 | Tang et al. | 364/472.01 |
| 5,528,504 | 6/1996 | Brewer | 364/468 |

*Primary Examiner*—Marc S. Hoff
*Assistant Examiner*—Bryan Bui
*Attorney, Agent, or Firm*—Joseph W. Malleck; Roger L. May

[57] ABSTRACT

A method is disclosed for developing a sheet metal forming process prediction method which is based on the application of an anisotropic hardening rule of plasticity in the mathematic theory.

11 Claims, 13 Drawing Sheets

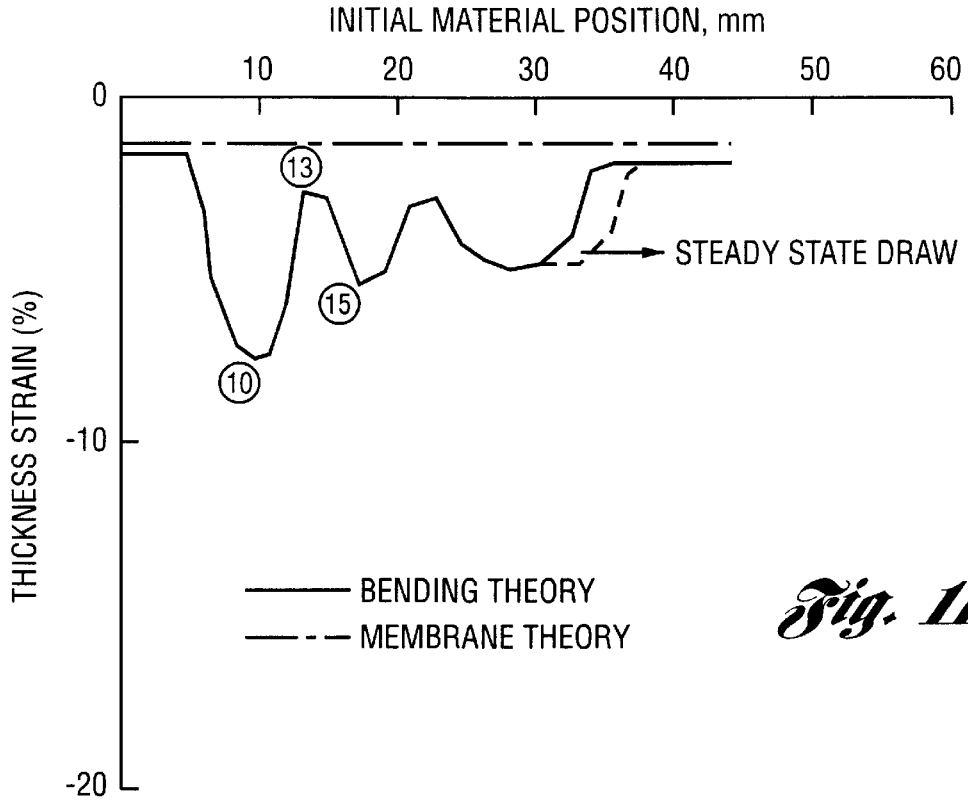
Fig. 11c
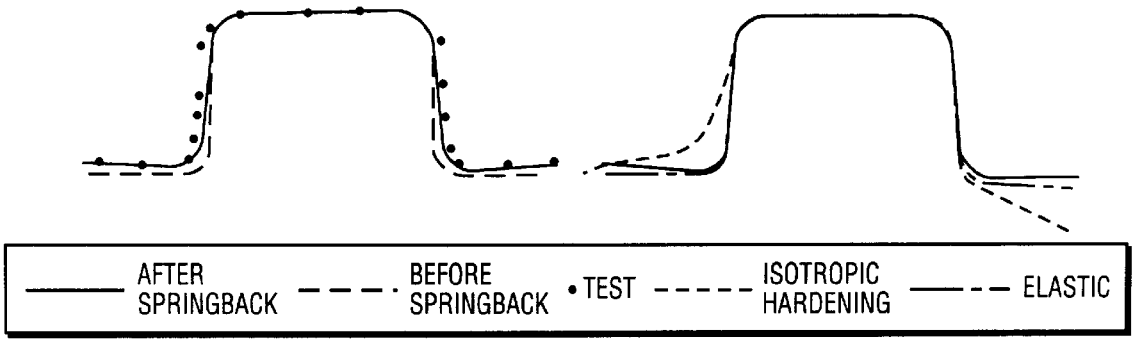
a: ANISOTROPIC HARDENING
Fig. 13a
b: ELASTIC AND ISOTROPIC HARDENING
Fig. 13b
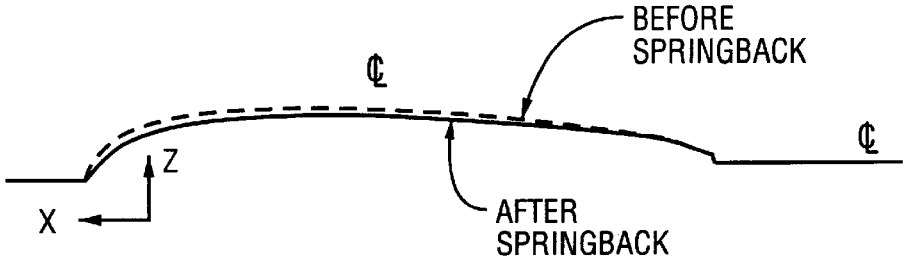
Fig. 14

METHOD OF APPLYING AN ANISOTROPIC HARDENING RULE OF PLASTICITY TO SHEET METAL FORMING PROCESSES

FIELD OF INVENTION

The present invention relates generally to a method of simulating sheet metal forming processes, and more particularly, to a method which utilizes principles of the anisotropic hardening rule of plasticity to simulate strain and stress during the sheet metal forming process.

BACKGROUND ART

In the stamping industry, shape distortion due to springback from flanging operations is a serious problem. In many cases, manual correction for shape distortion remains the common practice. It is estimated that $100 million dollars is spent each year by North American stamping plants alone to correct shape distortion defects. This concern is even more critical for lightweight materials such as high-strength steel and aluminum. The generation of springback is based on the hardening rule in the mathematical theory of plasticity used in sheet metal forming simulations.

For simplicity, most sheet metal forming simulation codes use the isotropic hardening rule developed by the mathematical theory of plasticity. However, this hardening rule does not produce realistic numerical results when used to analyze cyclic loading and unloading processes, such as those associated with stretching, bending and unbending over a small radius, or straightening an initial wrinkling as happens in a draw forming operation. FIG. 1 shows that the amplitudes of the uniaxial stress under the specified strain history predicted by the isotropic hardening rule are unreasonably high. Therefore, an anisotropic hardening theory to establish the incremental stress/strain relationship should be used for a more exact simulation of sheet metal forming processes.

The simplest anisotropic hardening rule is the kinematic rule by Prager and Ziegler. This hardening rule has been used to simulate the Bauschinger effect. However, for complex loading histories, actual material behavior substantially deviates from that predicted by this kinematic hardening rule. In addition, there is no definite method for determining the tangent modulus for a non-linear hardening material. The hardening rule proposed by Mroz, "On the description of anisotropic work hardening; J. MECH. PHYS. SOLIDS, Vol. 15, pp. 163–175, 1967, based on an observation of material fatigue behavior, is more appropriate for studying the influence of complex loading histories on material behavior which cannot be explained by either the isotropic or the kinematic hardening rule.

FIG. 2 shows the amplitudes of the uniaxial stress predicted by Mroz's rule under the same strain history as that in FIG. 1. Notably, the stress up to A' is identical to that by the kinematic hardening rule for the uniaxial stress case; however, there is no difficulty in determining the tangent modulus for a nonlinear hardening material.

C. Chu in "A three dimensional model of anisotropic hardening in metals and its application to the analysis of sheet metal formability," J. MECH. PHYS. SOLIDS, Vol. 32, pp. 197–212, 1984 extended Mroz's rule to establish a general constitutive equation in terms of the Cartesian tensor for the elastic plastic material in a three dimensional continuum. Unlike the isotropic and kinematic hardening rules, in which a single yield surface is assumed either to expand or translate, respectively, as a result of plastic deformation, Mroz's model introduced the concept of the field of work-hardening moduli which are defined by the configuration of a finite number of initially concentric yield surfaces in deviatoric stress space. The general rules governing the configuration change are that yield surfaces must move as rigid bodies with the loading point when it is in contact with them, and that the surfaces cannot pass through one another. Therefore, the surfaces will become mutually tangent at the loading point. As it passes from the elastic into the plastic region, the loading point will first encounter the smallest yield surface, which has a radius $\sqrt{2/3}\sigma_0$ wherein $\sigma_0$ is the initial yield stress. This surface will be pushed forward until the next larger surface is reached and then these two surfaces will then move forward together and so on. Each of these yield surfaces has a constant work hardening modulus. Since a surface is permitted only rigid body motion, its size may be used as a parameter to determine the modulus. When the material is deep into the plastic range and there are multiple yield surfaces tangent to one another at the loading point, the instantaneous modulus for continuous loading is the one associated with the largest yield surface in contact. This is the active yield surface. The smaller yield surfaces can become active again whenever unloading and reloading takes place.

The following derives the equations for change-of-yield surface size and central movement. The Von Mises yield criterion in Cartesian coordinate system is used. According to Mroz's rule, the yield's function is written as:

$$r=(3/2)\,(s_{ij}-a_{ij})\,(s_{ij}-a_{ij})-k^2=0(i,j=1,3) \tag{1}$$

where $s_{ij}$ are the deviatoric components of the Cauchy stress tensor $\Sigma$a is the position tensor of the center of the active yield surface, and $\sqrt{2/3}$ k is the radius of this surface. Note that the boldface character denotes a tensor, the index denotes its component and the repeated index means summation. The differential form of the yield's function is $$(3/2)\,(s_{ij}-a_{ij})\,(ds_{ij}-da_{ij})-kdk=0 \tag{2}$$

assuming the yield surface moves along a unit tensor b, the magnitude of da is the increment of the radius of the yield surface. Therefore, $$d\,a_{ij}=\sqrt{2/3}\,d\,k b_{ij} \tag{3}$$

Substituting this equation into Equation 2 yields $$dk=(3/2)\,(s_{ij}-a_{ij})ds_{ij}/\bar{k} \tag{4}$$

where $$\bar{k}=k+\sqrt{3/2}\,(s_{ij}-a_{ij})b_{ij}$$

and Equation 3 becomes $$d\,a_{ij}=\sqrt{3/2}\,[(s_{mn}-a_{mn})d\,s_{mn}/\bar{k}]b_{ij} \tag{5}$$

If the associated flow rule is assumed, the elastic, plastic constitutive equation can be derived in a procedure similar to that by means of the isotropic hardening rule.

An example depicting the change of active yield surfaces in a process for initial loading, unloading, reloading, unloading again and then reloading in a multiple-dimensional deviatoric stress component space is illustrated as follows:

1. Initial and Continuous Loading. The center of the initial yield surface is at the origin and its radius is $\sqrt{2/3}\sigma_0$ as shown in FIG. 3. One continuously loads to point $A_o$ where the radius of the yield surface is $\sqrt{2/3}k$ as shown in FIG. 3. The unit tensor b in Equation (3) is along $OA_o$. The center of the smallest yield surface with radius $\sqrt{2/3}\sigma_0$ go moves to $0_1^{(1)}$.

2. Unloading and Reloading. One unloads inside the smallest yield surface with center at $0_1^{(1)}$ and reloads to $A_1$ with the deviatoric stress increment ds. Using this increment and the unit tensor b, one can compute the center $0_1^{(i)}$ of the bigger yield surface and its radius $\sqrt{2/3}\,k_1$ from Equations (4) and (5). The updated unit tensor b is along $0_1^{(i)}A_1$ and the center of the updated smallest yield surface is along this line and thus can be located at $0_2^{(1)}$ as shown in FIG. 3.

3. Unloading Again and Then Reloading. If one unloads again inside the newest smallest yield surface and reloads into the plastic range again, the center of the active yield surface is along the line $0_1^{(i)}0_2^{(1)}$. This center cannot go beyond $0_1^{(i)}$ as shown in FIG. 3. If it does, the new center will lie on the line $OA_o$. If continuous loading occurs, the center of the active yield surface cannot go beyond O; otherwise, the yield surface with the radius $\sqrt{2/3}$ k will be active and move to tangent a yield surface with bigger radius than $\sqrt{2/3}$ k and its center still at 0.

The hardening rule proposed by Mroz better explores the influence of complex loading histories on material behavior which cannot be explained by either the isotropic or the kinematic hardening rule. However, Mroz's model cannot accurately predict springback for nonlinear hardening materials. The linear elastic material model underestimates the amount of springback, while the isotropic hardening rule makes wrong predictions.

Accordingly, there is a need for a revised approach to the traditional isotropic hardening rule, one which allows a more accurate simulation of forming processes and particularly the prediction of springback for nonlinear materials.

SUMMARY OF THE INVENTION

It is an object of the present invention to provide an improved method for the analysis of forming processes of sheet metal.

It is a further object of the present invention to provide a method for the analysis of sheet metal forming processes, such as the prediction of springback, for automotive sheet metal parts.

In carrying out the above objects and other objects and features of the present invention, a method is provided for predicting distortion of a sheet metal during a sheet forming process to form the sheet metal into a part, for use with a computer including memory and sheet forming tools. The method comprises calculating the strain increment for a load step associated with loading the sheet metal in the sheet forming tools. The strain increment is sub-divided for each load step associated with loading into a plurality of sub-intervals. For each of the plurality of sub-intervals of strain increment associated with loading, the stress increment is calculated under Mroz's hardening rule equations. For each load step associated with unloading the part after formation, the strain increment is calculated. The resultant strain increment is then sub-divided for each load step into a plurality of sub-intervals. During unloading, for each of the plurality of sub-intervals of strain increment, the stress increment is calculated based on the equations for the anisotropic rule of hardening. For each load step associated with reloading the sheet in the forming tools, the strain increment is then calculated. The strain increment for each load step associated with reloading is sub-divided into a plurality of sub-intervals and the stress increment is calculated based on each of the plurality of sub-intervals of strain increment under Mroz's hardening rule equations.

BRIEF DESCRIPTION OF THE DRAWINGS

FIG. 11*c* is a graph illustrating the thickness strain distribution in the plane-strain draw.

FIG. 13*a* is a drawing illustrating a section across an S-rail after and before springback.

FIG. 13*b* is a drawing illustrating a section across an S-rail using the isotropic hardening rule and the linear elastic material model for springback analysis.

FIG. 14 is a drawing illustrating an aluminum hood springback modeling test.

DETAILED DESCRIPTION OF THE BEST MODE

Figure 1:
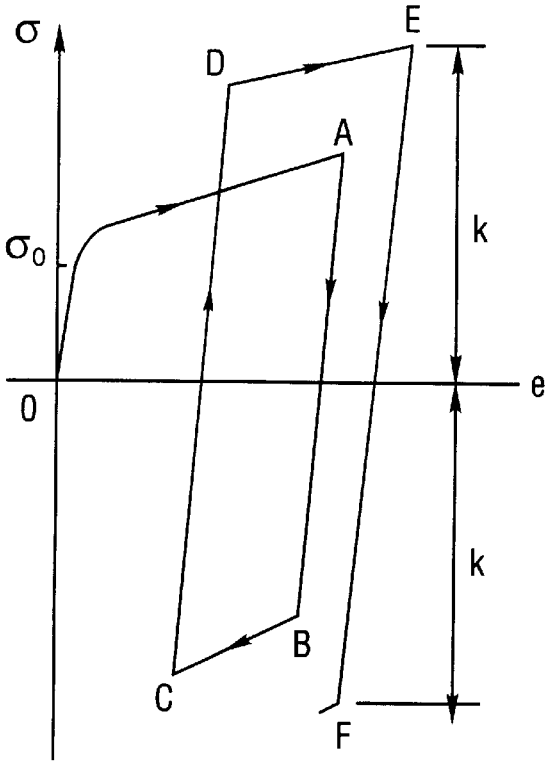
FIG. 1 is a stress-strain graph illustrating the relationship between stress and strain experienced from isotropic hardening.
Figure 2:
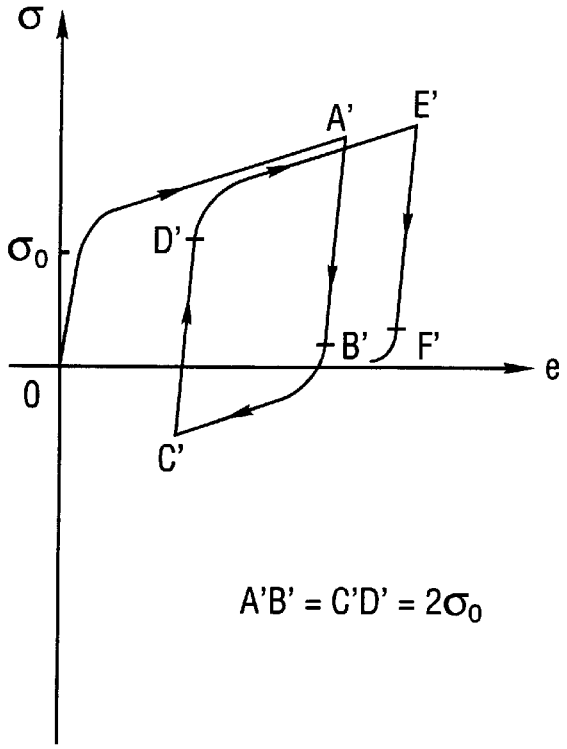
FIG. 2 illustrates a stress-strain graph, similar to FIG. 1, but illustrating the stress-strain as depicted under the Mroz rule.
Figure 3:
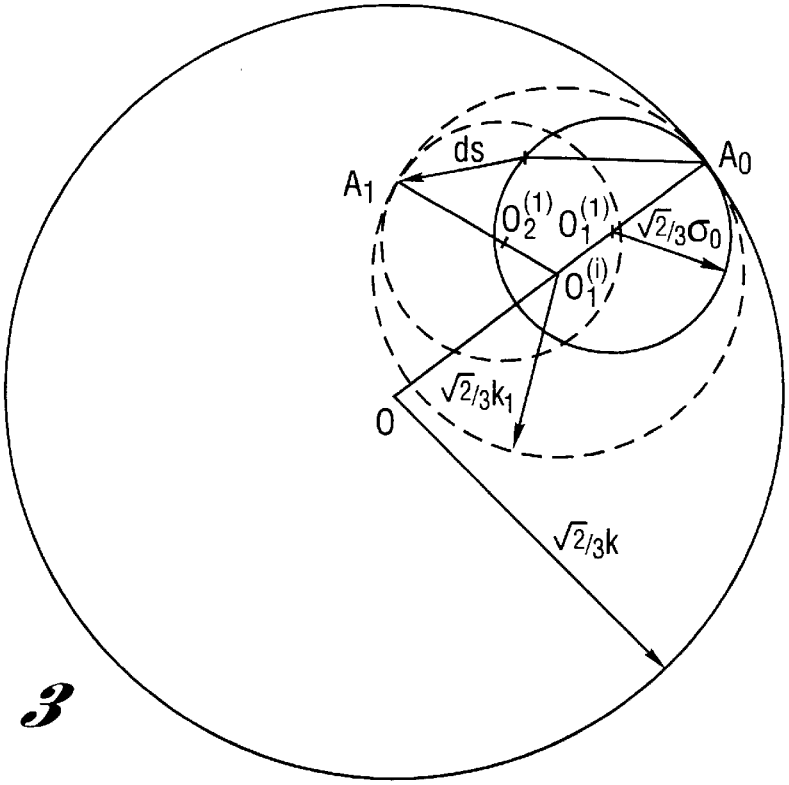
FIG. 3 is a graph which illustrates the application of the anisotropic hardening rule before and after springback.

This invention concerns the replacement of the isotropic hardening rule currently utilized to produce the springback effect on sheet forming panels with an anisotropic hardening rule which allows for more accurate simulation of forming processes and the prediction of springback.

In sheet metal forming operations, the part being formed conforms closely to the die shape while inside the forming tools. However, when the part is taken out of the tools, its shape changes; this change is referred to as springback. Springback thus generally refers to the tendency for a member being formed to return to some shape intermediate its original shape and that of the tool. Springback is especially severe for aluminum and high strength steel. Compensating for this distortion in shape, the first step is to predict the amount of springback in a part for a given design of forming tools.

To predict springback, which is controlled by stresses at the end of draw die closure, the focus of the prediction accuracy must be shifted to the stress distribution across the entire stamping process. This task presents many more demands than those required for predicting fracture and wrinkling/buckling. Quasi-static analysis with implicit time integration is the most appropriate method for accurately predicting the overall strain and stress distribution across an entire stamped part. In addition, since springback involves unloading caused by the release of the part from stamping tools, it requires a material model with a cyclic stress-strain relationship.

As in the forming analysis, it is necessary to solve a surface contact problem with friction to find the final shape of a part after release from the forming tools. When using the implicit method, the formulation for a surface contact problem involves the material derivatives of the contact forces in terms of the curvatures of the tool surface. Though an iterative process not requiring curvatures can be used, the computation is still very complex.

An approximate method not requiring the solution of a surface contact problem can be handled using springback analysis. From the forming analysis after die closure, the tool pressure and the frictional force acting on the sheet metal part can be computed. Springback can further be computed from the deformed shape of the part by releasing the tool pressure and the frictional force. Applying these forces with equal magnitudes but opposite signs to the deformed part with the appropriate support to eliminate any rigid body motion, we can compute the additional deformation of the structure due to springback. A stamped part must be supported to eliminate all three rigid body translations and rotations for a statically determinant structure. The geometric nonlinearity due to a large deformation and the material nonlinearity due to reversed plastic flow in the springback analysis are still considered.

Under this invention, C. Chu's constitutive equation is modified for the large strain in a curvilinear coordinate system; therefore, the modified equation can be applied to nonlinear shell analysis. Under this thin shell theory, which has been used in analyzing sheet forming operations, the plane stress condition in a layer parallel to the middle surface is assumed. The transversely anisotropic material property in terms of the parameter R is also included in the yield or loading surface by the proposed rule. Accordingly, under this invention and the equations proposed herein, R represents a material parameter expressing the transversely anisotropic property of a sheet.

In order to gain a better understanding of the phenomenon behind sheet metal forming processes, it is necessary to analyze the mechanisms at work during the forming process. This effort involves understanding stress distribution as it relates to different forming mechanisms. Based on the simulation, the contour of sheet metal can be determined to prevent shape distortion defects by modification of the die surface shape.

The complex shapes of the contoured members that are utilized for forming automobiles parts are inherently difficult to form. Due to the shapes required by styling and aerodynamics and because of the emphasis on load carrying capability combined with weight efficiency, optimized designs are created, with the use of high strength, aluminum alloys. The criticality of design requires that precise forming tolerances be maintained, without sacrificing the fatigue life or strength of the member as a result of the forming process chosen.

Figure 4:
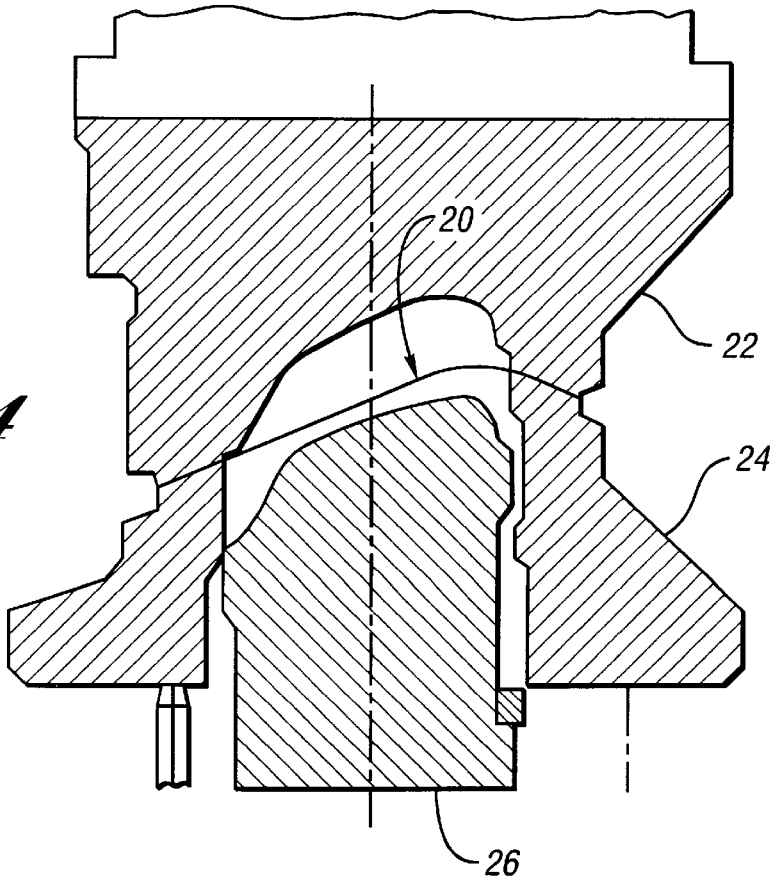
FIG. 4 is a sectional view of a stretch draw die apparatus for an automotive body panel in the binder wrap stage of the metal forming process, the punch being in an inactive state.
Figure 5:
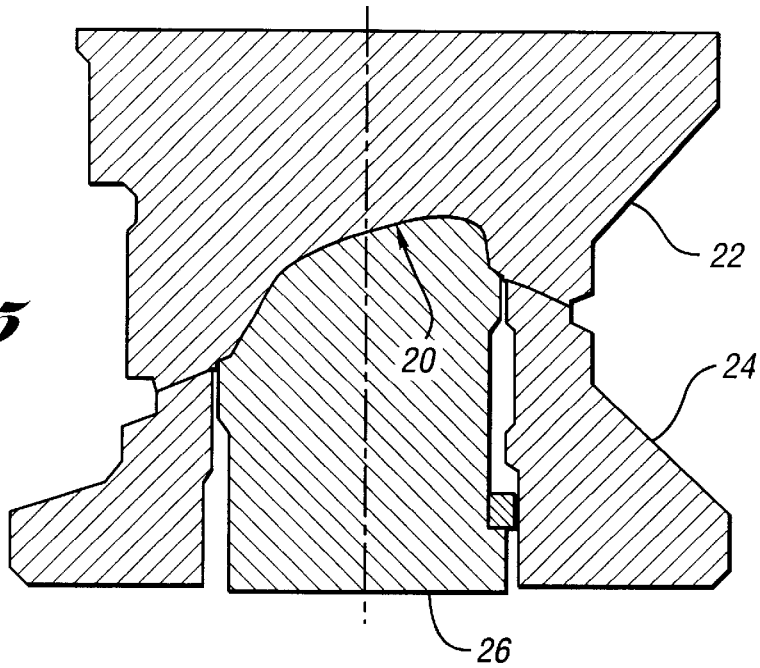
FIG. 5 is a sectional view of a stretch draw die apparatus for an automotive body panel in the die closure stage of the metal forming process, the lower punch being still in an inactive position, the upper die with a lower binder ring having descended and pressed the sheet onto the lower punch to form the part.

Referring now to FIGS. 4 and 5, there are shown sectional views of a stretch draw die apparatus for an automotive body panel in the binder wrap stage and the die closure stage, respectively, of a sheet metal forming process. In the binder wrap or binder set stage, best shown in FIG. 4, the binder ring is closed and holds the perimeter of the sheet metal blank 20. The upper die 22 which is one piece with the upper binder ring, lowered onto the lower binder ring 24 which is floating in this stage, setting the binder shape. In the die closure stage best shown in FIG. 5, the lower binder ring 24 together with the upper ring and die 22, descends to press the sheet onto the stationary lower punch 26, forming the contoured automotive body panel. Although the drawing figures illustrate a stretch draw die apparatus, the present invention is equally applicable to other apparatus, such as a die apparatus of a conventional toggle draw. It should be noted that some buckling and/or wrinkling occurring during the forming can be stretched out before completion of the tool travel. For outer panels, buckling and/or wrinkling on the part after forming is absolutely unacceptable. However, for some inner parts, a little buckling and/or wrinkling is acceptable after forming.

The modelling of the deformation of a sheet of metal, under the present invention, is preferably carried out on a computer, such as an IBM RS6000/595 workstation. The computer preferably includes a CPU, a RAM or core memory, disk memory, a display or similar output, and an input means, such as a keyboard. The computer simulates the formation of automobile body panels from sheet metal. Given the modelling equations of the present invention, the sheet metal deformation after binder wrap is determined. This step is necessary prior to performing die closure analysis, including prediction of sheet metal deformation and stress distribution during die closure. This surface modeling is achieved utilizing a software preprocessor, which could be written in the FORTRAN programming language, which transforms line data input from a designer. Typically, the designer creates binder line data and punch/die line data initially utilizing an appropriate CAD program. The line data represents the tool surfaces, such as the tool ridges and the like. In the preferred embodiment, the software preprocessor creates a triangular mesh establishing the connectivity of the tool surface, utilizing a nearest neighbor algorithm which fills in the surface between the points on the lines.

The tool surface triangular mesh is a plurality of interconnected triangles, the vertices of which are referred to as nodal points or nodes. Utilizing the nearest neighbor algorithm will sometimes cause an inconsistency between the connectivity of the original line data and the resulting tool surface mesh, resulting in errors of shape, which are preferably corrected. The tool surface triangular mesh is then provided as an input to the die closure analysis, described in greater detail below, to test for contact between the tool surface and the sheet metal.

Figure 6:
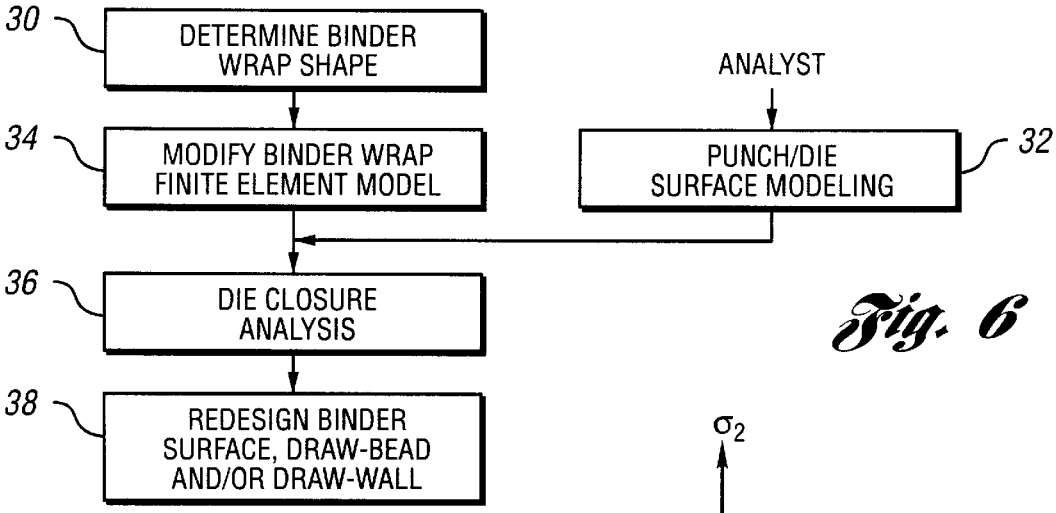
FIG. 6 is a general flow chart detailing the steps for prediction of deformation and stress distribution of the present invention.

As shown in FIG. 6, at step 34, the binder wrap shaped finite element model determined at step 30 is modified by the software preprocessor at step 34. The binder wrap shape is also represented by a triangular mesh. During this modification step, the binder wrap finite element model mesh is refined. In other words, the analyst is allowed to alter the nodal positions of the mesh by varying the positions of the nodes. However, the modified nodal positions will still lie on the binder wrap surface determined at step 30, i.e. the surface of the binder wrap will stay the same. It should be appreciated by one of ordinary skill in the art that this modification provides the advantage of allowing the analyst to increase the density of nodes in particular areas, such as an area of high curvature, to more accurately predict strain concentration associated with the die closure stage of the metal forming process.

The step of modifying the binder wrap finite element model also preferably includes defining the constraining forces due to binder pressure and the draw-bead. Preferably, a function is defined wherein the input is nodal displacement and the corresponding output is the resulting opposing force on the node as the sheet metal is formed. Under this invention, the constraining forces are modeled as an elastic-plastic spring. Still further, binder wrap finite element model modification of step 34 entails defining the sheet metal material properties, in addition to Young's modulus of elasticity and Poisson's ratio, material parameters of the plastic range, and defining the friction coefficient of the metal and the tool surfaces.

With continuing reference to FIG. 6, at step 36, die closure analysis is performed. In general, the method of the present invention involves solving a sequence of force balancing problems, referred to as load steps, upon the modified binder wrap triangular mesh. At each load step, the tool advances to a new position, causing boundary condition updates for the contacting nodes. There are two kinds of contacting nodes. Nodes contacting the punch/die surface are called contact nodes, whereas nodes inside the binder contacting the upper binder ring and the lower binder surface on the die are called binder nodes.

At each load step, the computer searches for new nodal positions which satisfy the new boundary conditions and produce balanced internal forces and external forces, the spring and friction forces, at all nodes to model the draw-bead, i.e. until equilibrium is reached. These load steps are continued until the tool is advanced to its final position, and the automotive body panel has been formed. The search for new nodal positions is performed iteratively, with each iteration preferably producing a better result with a smaller unbalanced force. When the unbalanced force is small enough, the next load step begins and generates new boundary positions again. Periodically during the analysis, the predicted stress and deformation can be viewed to check defects such as potential permanent buckling and/or wrinkling.

The computer is then provided with data from steps 32–34 of FIG. 6 and additional control parameters, such as tolerances. As previously described, this data includes the tool surface triangular mesh from step 32 and the modified binder wrap triangular mesh from step 34. Variables are initialized to predetermined and/or default values.

As an example, the tool is advanced an incremental amount, such as 1 mm for an outer body panel. As the tool advances, the tool surface contacts the sheet metal. The computer then determines the contact nodes between the tool surface mesh and the sheet metal mesh by measuring the penetration of sheet metal nodes into the tool surface. This penetration gives rise to a boundary condition which enforces a displacement increment on the contact nodes, forcing them to the tool surface.

The material matrices, i.e. the stress-strain relationships, are established/updated so as to ensure accuracy. To form a complex body panel, there may be stress unloading in the panel even before the tool reaches the final position. Before the stress stage can be determined, at a sampling point in the sheet detected under an unloading condition, the elastic-plastic material matrix is utilized to establish the tangent stiffness matrix, the determination of which is fully described in a paper entitled "Sheet Metal Forming Modeling Of Automobile Body Panels" by S. C. Tang, J. Gress and P. Ling, published in 1988 by ASM International at the Controlling Sheet Metal Forming Processes 15th Biannual Congress, which is hereby expressly incorporated by reference in its entirety. Once the displacement increment is solved utilizing a tangent stiffness matrix mentioned in the paper and explained in greater detail below, the strain increment at that sampling point can be obtained, based on a known strain and displacement increment relationship. The stress increment is then computed using either Mroz's hardening rule or the anisotropic hardening rule of plasticity as set forth in this invention. If the computed equivalent stress increment is negative, the stress date at that point is under unloading, and the stress increment is preferably computed by the plastic-elastic stress-strain relationship according to the anisotropic hardening theory of plasticity.

Accordingly, under this invention, the stress change is calculated based on the anisotropic hardening theory of plasticity to compute the stress increment after detecting unloading. After this load step, a regular unloading process might be applied if unloading continues. The stress-strain relationship in the incremental solution for the next load step will be consistent with that used as a computation of the stress increment.

Since we want to include the anisotropic property of a sheet, there is no advantage to use the stress deviatoric components in the yield criterion. As mentioned previously, this formulation will be used in our three dimensional analysis of sheet metal forming processes; therefore the finite strain should be included. A thin shell element referred to as a convected coordinate system is used in this analysis. For simplicity, the yield criterion should not include the metric tensor on the deformed shell surface explicitly; therefore it is in terms of the mixed components of the Kirchhoff stress tensor which is used in the shell element. Following Chu's generalization and taking care of the transversely anisotropic property, Hill's yield surface, f, for the plane stress state is modified for the anisotropic hardening rule as follows:

$$f = \frac{1+2R}{1+R}\left(r_\beta^\alpha r_\alpha^\beta - \frac{R}{1+2R} r_\alpha^\alpha r_\beta^\beta\right) - k^2 = 0 \tag{6}$$

where $$r_\beta{}^\alpha = \tau_\beta{}^\alpha - a_\beta{}^\alpha (\alpha,\beta=1,2) \tag{7}$$

$\tau_\beta{}^\alpha$ are the mixed components of the Kirchhoff stress tensor $\tau$, a is the tensor to express the center of the active yield surface and k is the size of the yield surface which is used to determine the tangent modulus of the nonlinear hardening material. The change of the center of the active yield surface, $da_\beta{}^\alpha$ is written in the following form:

$$da_\beta^\alpha = A\, dk\, b_{\beta\alpha} \tag{8}$$

where b is a unit tensor along which the center of an active surface moves, to be determined by the loading history and the coefficient A which is no longer the constant value, $\sqrt{2/3}$, as in Eq. (3) is computed from the active yield surface expressed by Eq. (6) by taking the stress components along the specified direction of the unit tensor b. An example for computing this coefficient will be given later. The change of the active yield surface size, dk, is computed by differentiating Eq. (6) and using $da_\beta^\alpha$ in Eq. (8). Thus, it is:

$$dk = \frac{1+2R}{1+R}\left(r_\beta^\alpha d\tau_\alpha^\beta - \frac{R}{1+2R} r_\alpha^\alpha d\tau_\beta^\beta\right) \Big/ \bar{k} \tag{9}$$

where $$\bar{k} = k + A\frac{1+2R}{1+R}\left(r_\beta^\alpha b_\alpha^\beta - \frac{R}{1+R} r_\alpha^\alpha b_\beta^\beta\right)$$

Using dτ, one computes dk first and then da from Eq. (8). Therefore, the formulation of the hardening rule is completed.

The rest of the derivation for the elastic-plastic constitutive equation is similar to that of the isotropic hardening rule. Its final form which is ready for use in the finite element analysis is as follows:

$$\tau\alpha^{\beta=D\alpha\beta\gamma\delta}\epsilon_{\gamma\delta} \tag{10}$$

where the dot denotes the convected rate and the material matrix D factors in the translated stress tensor r. Note that the contravariant components of the Kirchhoff stress rate may be converted to the mixed components used in the anisotropic hardening rule, by multiplying the metric tensor g on the deformed shell surface.

Figure 7:
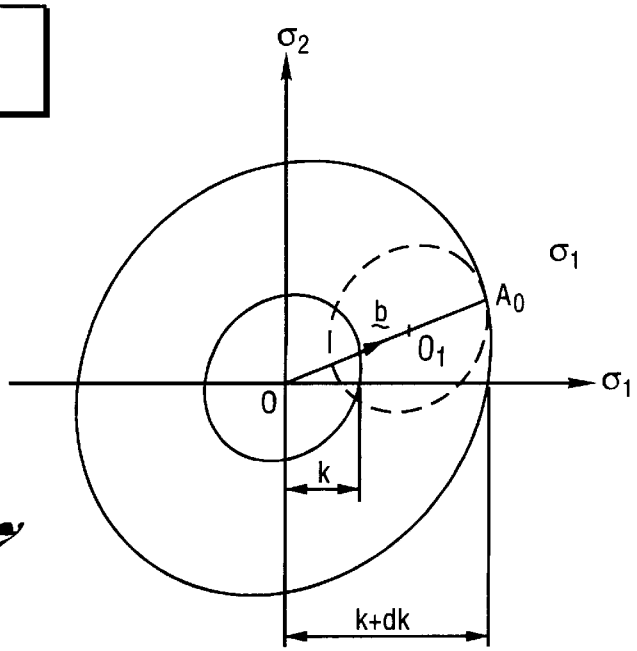
FIG. 7 is a graph illustrating yield surfaces in principal stress space during loading.

A special case for the plane stress state in the principal stress space, shown in FIG. 7, is used as an example to compute the coefficient A in Eq. (8). Let $$\sigma_\alpha = \tau_\alpha^\alpha (\text{no sum on } \alpha) \tag{11}$$

where $\sigma_\alpha$ are the principal components of the Cauchy stress tensor. Let the origin of the principal stress space be the center of the active yield surface with the size k. During loading process, this center moves along a unit tensor $b(b_1,b_2)$ and the yield surfaces touch the larger yield surface with the size k+dk at a point $A_o$ as shown in FIG. 7. At the tangent point $A_o$, the principal stress components:

$$\sigma_1 : \sigma_2 = b_1 : b_2 \tag{12}$$

Substituting Eqs. (11) and (12) into Eq. (6) and noting that $\tau_\beta^\alpha = 0$ for $\alpha \neq \beta$, one can compute the movement of the yield surface center from 0 to $0_1$ as follows:

$$|d\,a| = 00_1 = \left(1 - \frac{2R}{1+R} b_1 b_2\right)^{-1/2} dk$$

Hence, $$A = \left(1 - \frac{2R}{1+R} b_1 b_2\right)^{-1/2} \tag{13}$$

To determine A in Eq. (8) for the general plane stress case: $r_\beta^\alpha$ is parallel to $b_\beta^\alpha$; $r_\beta^\alpha = \lambda b_\beta^\alpha$ Rewrite Eq. (6):

$$f = g(r_\beta^\alpha) - k^2 = 0 \tag{14}$$

where $$g(r_\beta^\alpha) = \frac{1+2R}{1+R}\left(r_\beta^\alpha r_\alpha^\beta - \frac{R}{1+2R} r_\alpha^\alpha r_\beta^\beta\right)$$

From Eq. (14):

$\lambda^2 = k^2/g(b_\beta^\alpha)$, $\lambda = k/[g(b_\beta^\alpha)]^{1/2}$, $\|r_\beta^\alpha\| = \lambda \|b_\beta^\alpha\| = \lambda$, since $b_\beta^\alpha$ is a unit tensor.

$\therefore \|r_\beta^\alpha\| = \lambda = k/[g(b_\beta^\alpha)]^{1/2}$.

$\|da_\beta^\alpha\| = dk/[g(b_\beta^\alpha)]^{1/2}$ along $b_\beta^\alpha$ $da_\beta^\alpha = dr_\beta^\alpha$ along $b_\beta^\alpha$ $da_\beta^\alpha = A\, dk\, b_\beta^\alpha$ $\therefore A = [g(b_\beta^\alpha)]^{-1/2}$ Based on the anisotropic hardening rule, a sub-program was developed to compute the elastic-plastic constitutive equation for the finite strain deformation. The sub-program involves two principal stress components and provides a two-dimensional sheet metal forming analysis program. Another sub-program for a general plane stress state was also developed for the shell element used in a three-dimensional sheet metal forming analysis program.

Once the displacement has been updated, based on the stress and strain calculations, the computer determines whether the tool is at its final position. If the tool has not reached a final position, stress and strain increments are determined for the remaining load steps. If the tool is in its final position, the final results, the predicted total stress state and associated springback are provided.

Once the die closure analysis is completed, the binder surface, draw wall and draw-beads can be redesigned and reconstructed based on predicted sheet springback so as to prevent failures from sheet metal distortion due to springback.

Having prepared a proposed anisotropic hardening rule, a process to be used in conjunction with a computer was devised. After convergence of each load increment (tool movement) the stresses are updated. From the increment deformation for each load step, Mroz's hardening rule is used to compute the stress increment and then the total stresses up to that load step.

For the initial loading and continuous loading, the center of the yield surface and subsequent yield surface is at the origin of the stress space. From the strain increment, the stress increment can be computed from the tangent modulus of the uniaxial stress-strain curve of the material and the updated stress and equivalent stress k. The size of the updated loading surface becomes k. For numeral accuracy, the strain increment is subdivided for each load step into between 150 and 250 sub-intervals, and more preferably 200 sub-intervals, to compute the stress increment.

Due to drastic changes of stresses associated with unloading under the isotropic hardening theory, Mroz's rule was modified to accommodate the present anisotropic hardening theory. By means of the incremental deformation theory of plasticity, the size of the loading surface is reduced using the strain increment (decrement). In this case, $\Delta\sigma_0 < 0$, the center of the reduced loading surface moves in the opposite direction to that of the loading case along the unit tensor b. In application of the increment deformation theory to the increment of strains for each step, it is preferred that the strain increment is sub-divided into a plurality of sub-intervals most preferably a minimum number of five sub-intervals. After the size of the loading or yield surface is reduced, the size of the active yield surface becomes $k_0$. The elastic material matrix is set at that point for the next loading step. In the meantime, the history of the center and the size of the loading or yield surface is stored in the computer.

Under reverse reloading, in addition to the size change of the loading surface, its center also moves according to Mroz's theory. To compute the stress increment under reverse reloading, 150–250 sub-intervals, or more preferably 200 sub-intervals are used to compute the stress increment and new center of the loading surface for each loading step. Another step in the process involves checking the size of the loading surface to ensure that it is larger than that from the last one in the history file. If it is larger, the direction b is used from the history file. Accordingly, for the next sub-increment, the center of the loading surface will be along this b unit tensor.

EXAMPLE 1

Figure 8A:
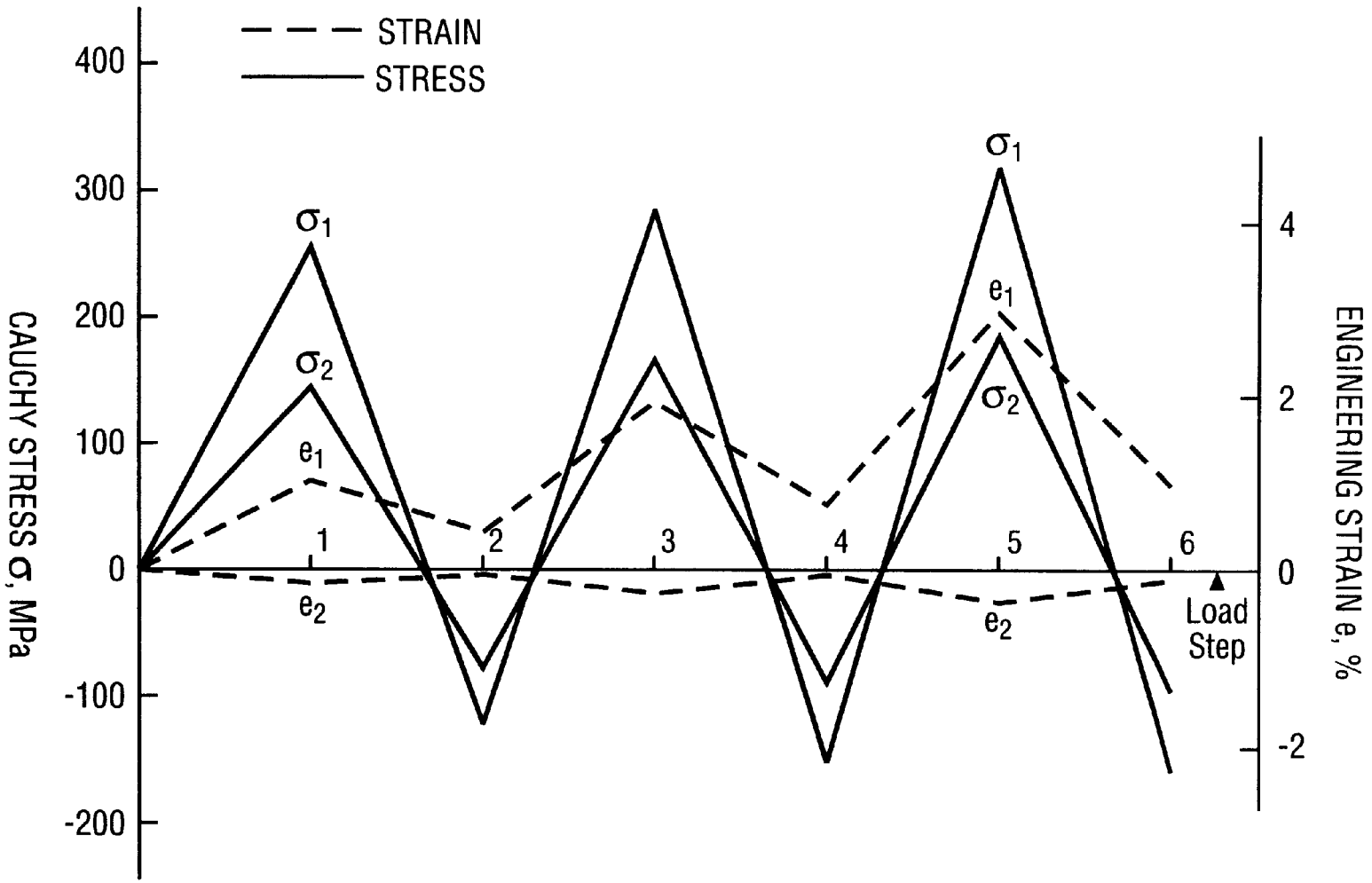
FIG. 8*a* is a graph illustrating the principal stress for cyclically increasing strain from the anisotropic hardening rule.
Figure 8B:
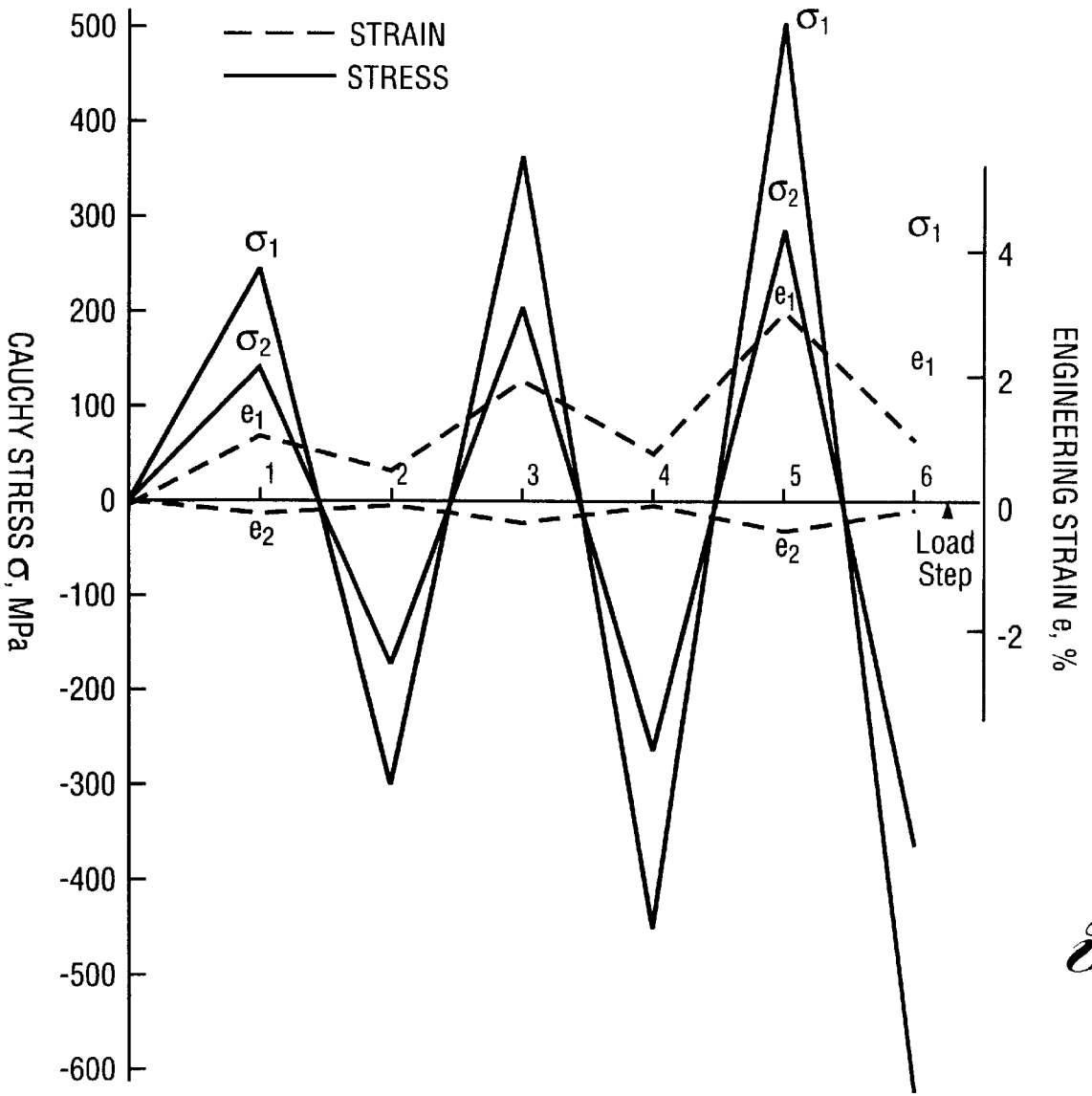
FIG. 8*b* is a graph illustrating the principal stress for cyclically increasing strain from the isotropic hardening rule.

The strain versus the load step was specified in FIG. 8 to compute the corresponding stress. The amplitude of the strain for each loading cycle is increasing, so that the active yield surface size is also increasing and there is no need to memorize the information of the inactive yield surfaces for this set of strain history. FIG. 8*a* shows the history of the stress from the present hardening rule; while FIG. 8*b* shows that from the conventional isotropic hardening rule. They are identical until the unloading occurs at load step 1. The stress amplitudes at load steps 5 and 6 from the isotropic rule are unreasonably high.

EXAMPLE 2

Figure 9A:
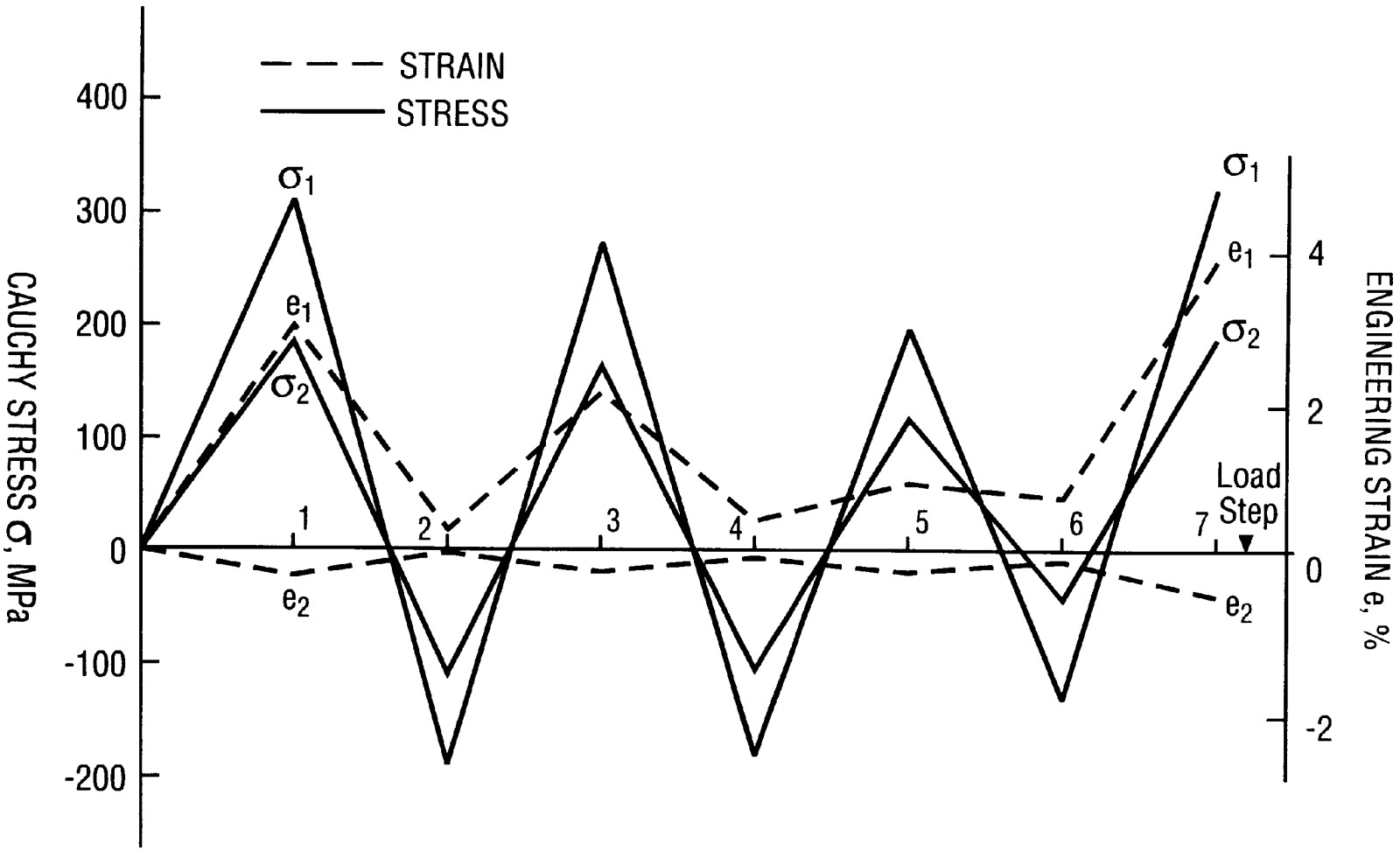
FIG. 9*a* is a graph illustrating the principal stress for cyclically decreasing strain and increasing at the last step from the anisotropic hardening rule.
Figure 9B:
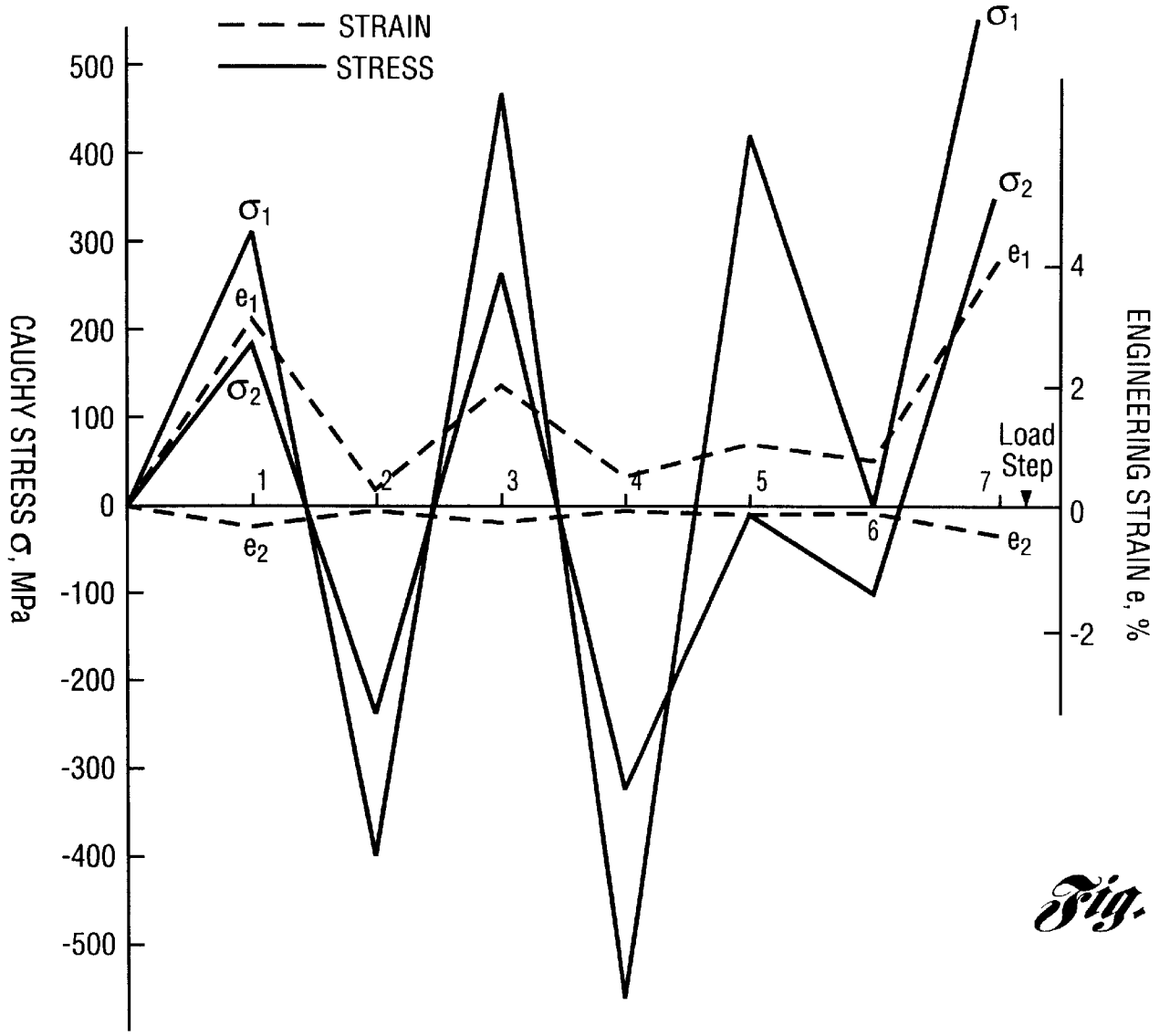
FIG. 9*b* is a graph illustrating the principal stress for cyclically decreasing strain and increasing at the last step from the isotropic hardening rule.

The strain versus the load step was specified in FIG. 9. We wanted to compute the corresponding stress. Since the amplitude of this specified strain for each loading cycle was decreased until the last loading step, we needed to memorize the information of the inactive yield surfaces. In this example, there were as many as five inactive yield surfaces to be memorized in addition to that of the active one. FIG. 9*a* shows the stress history from the present hardening rule; while FIG. 9*b* shows that from the isotropic hardening rule. The amplitudes of the stress in FIG. 9*b* are too high.

EXAMPLE 3

Figure 10A:
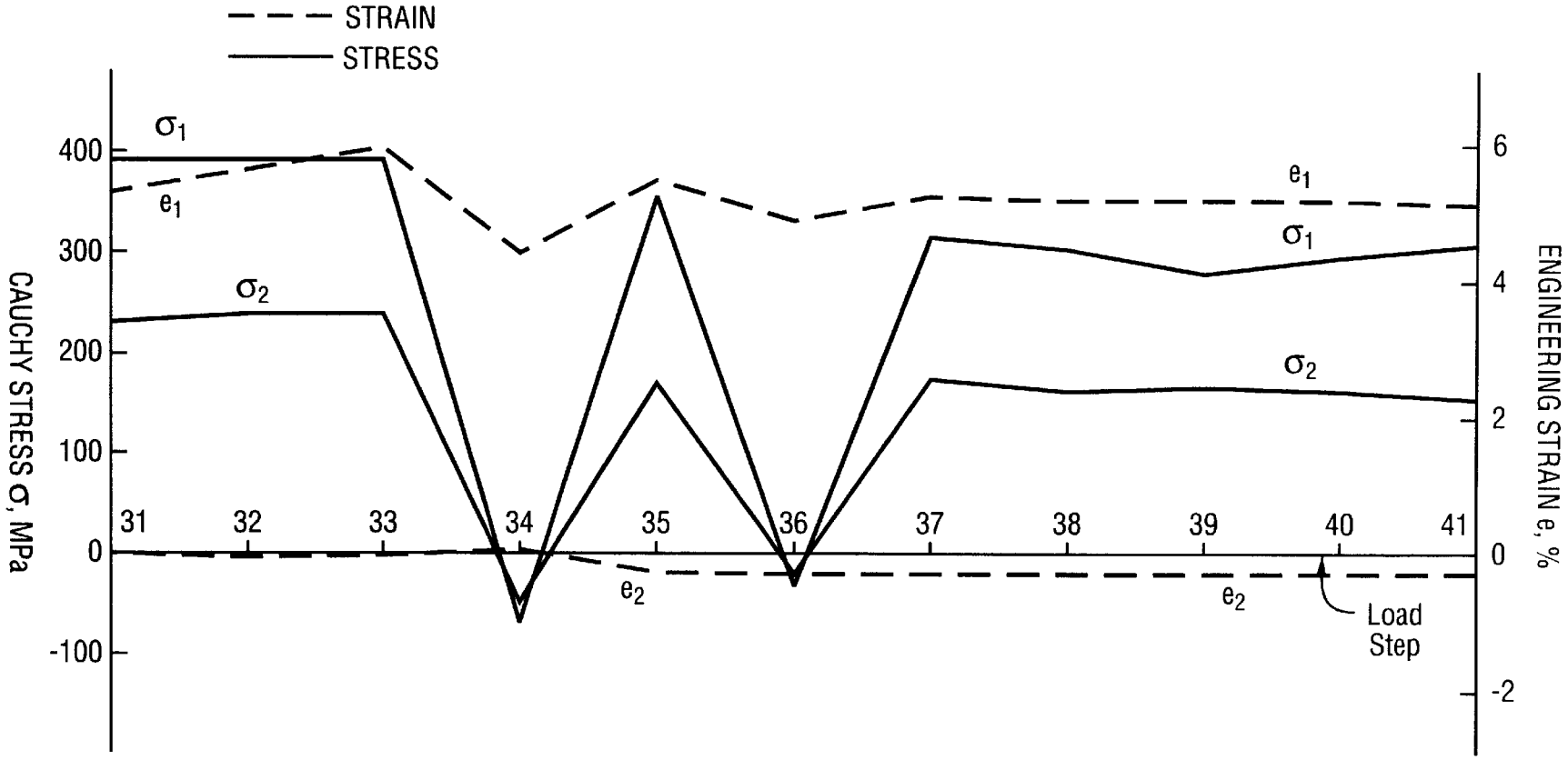
FIG. 10*a* is a graph illustrating the principal stress in a finite element for a production body panel from the anisotropic hardening rule.
Figure 10B:
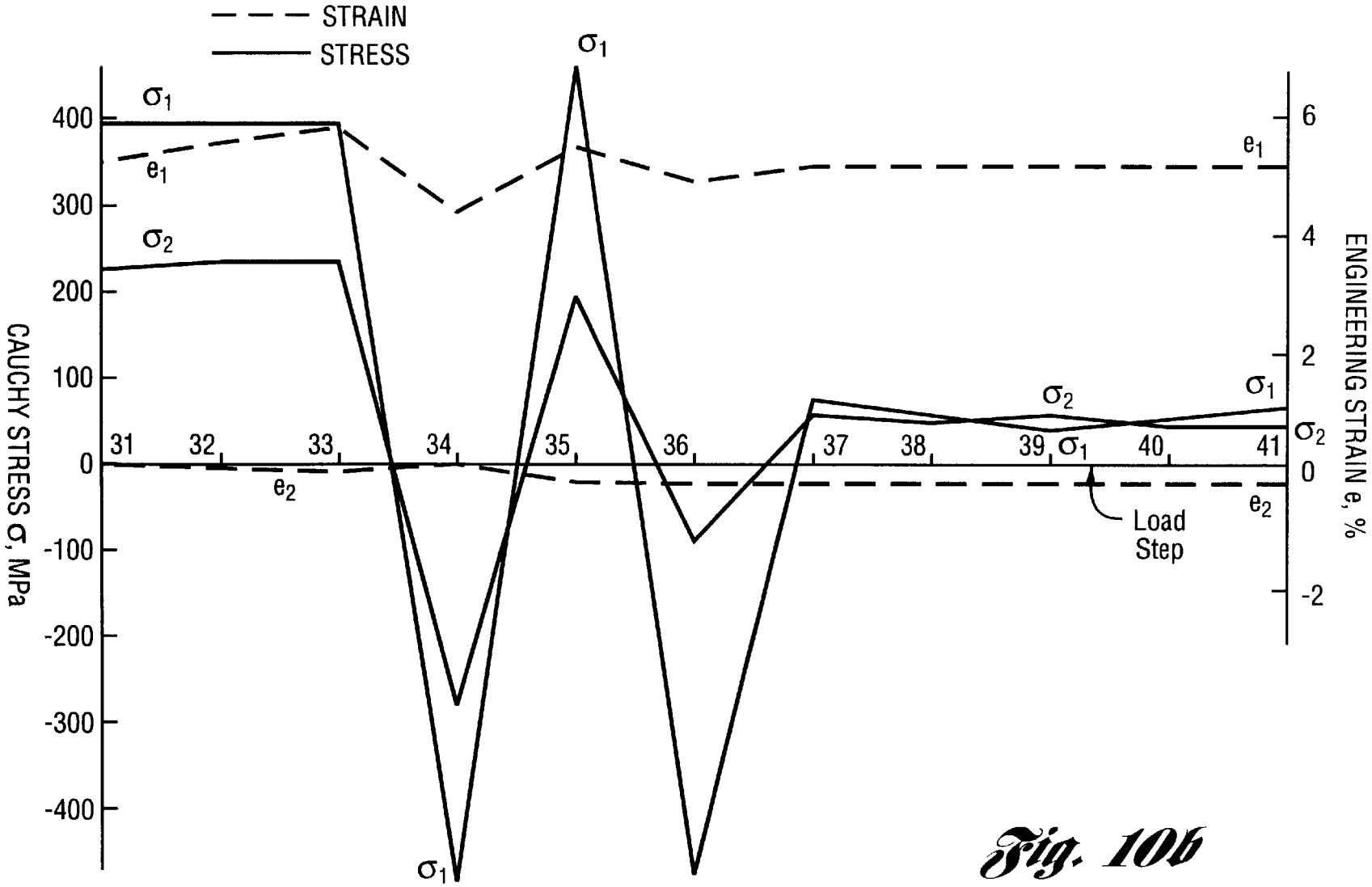
FIG. 10*b* is a graph illustrating the principal stress in a finite element for a production body panel from the isotropic hardening rule.

The strain history shown in FIG. 10 was taken from a finite element of a production automobile body panel analyzed by our three-dimensional sheet metal forming program at 50% of the total punch travel. Because a finite element node close to that element slipped out from the tool contact, there was unloading for the element at load step 33. In order to use the present program to compute the stress, we assumed that the principal direction of the element stress did not change from the load step 31 to 41. FIG. 10*a* shows the amplitudes of the stress from the present hardening rule are reasonable in comparison to those shown in FIG. 10*b* from the isotropic hardening rule.

EXAMPLE 4

Figure 11A:
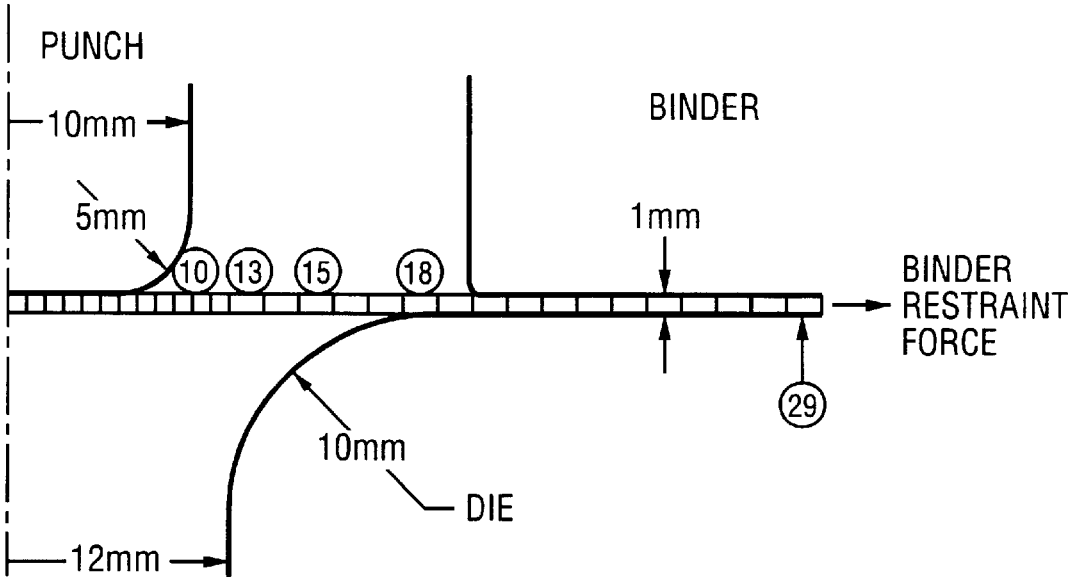
FIG. 11*a* is a graph depicting the finite element model of the plane-strain draw.
Figure 11B:
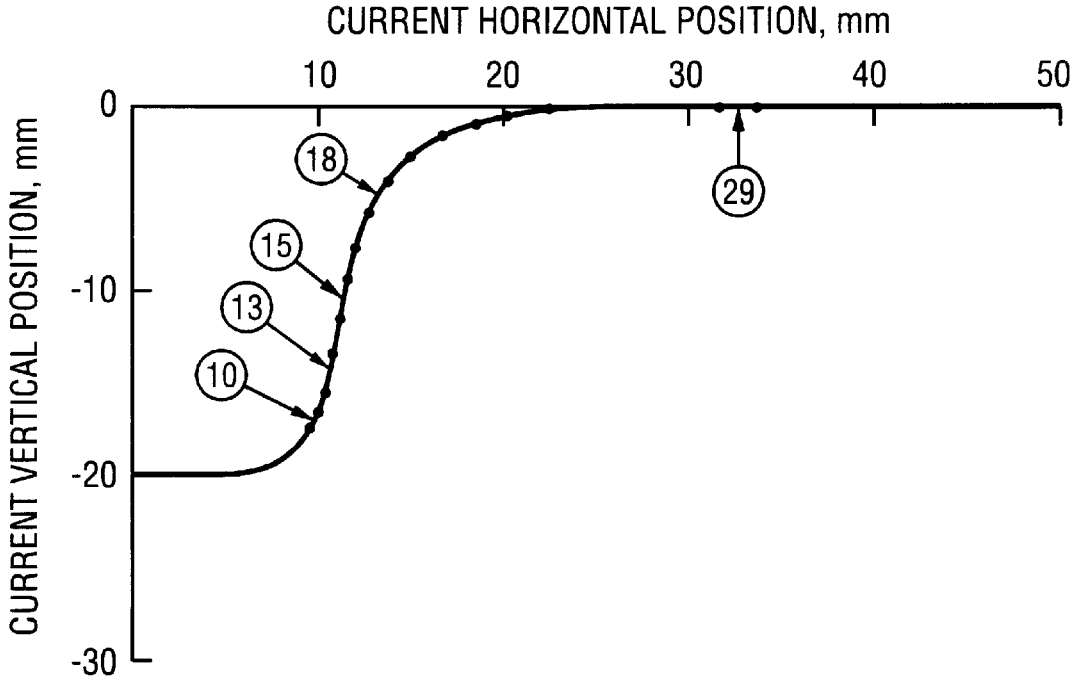
FIG. 11*b* is a graph illustrating the final deformed position in the plane-strain draw.
Figure 12A:
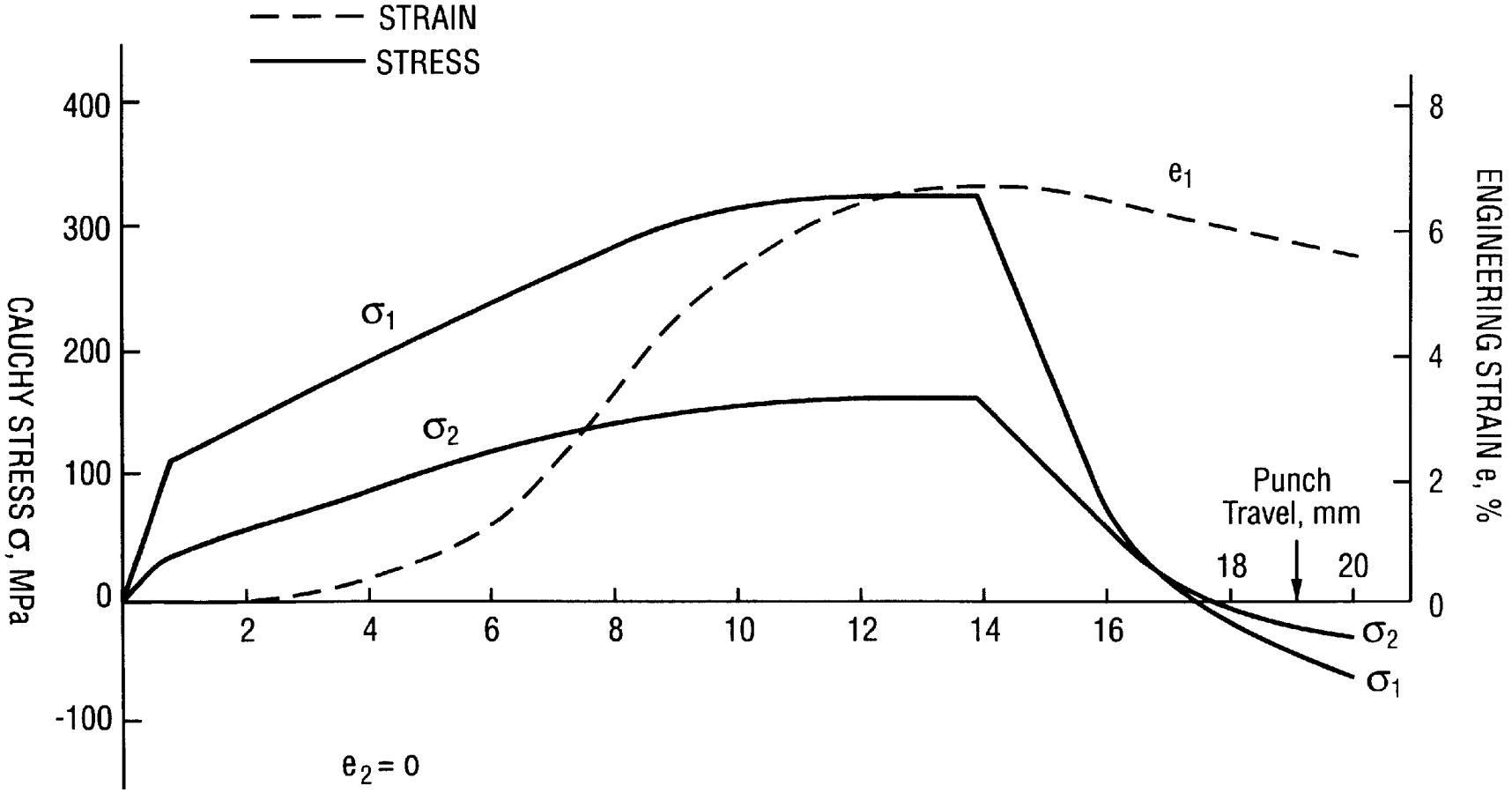
FIG. 12*a* is a graph illustrating the stress and strain history of the top surface of element 15 from the anisotropic hardening rule.
Figure 12B:
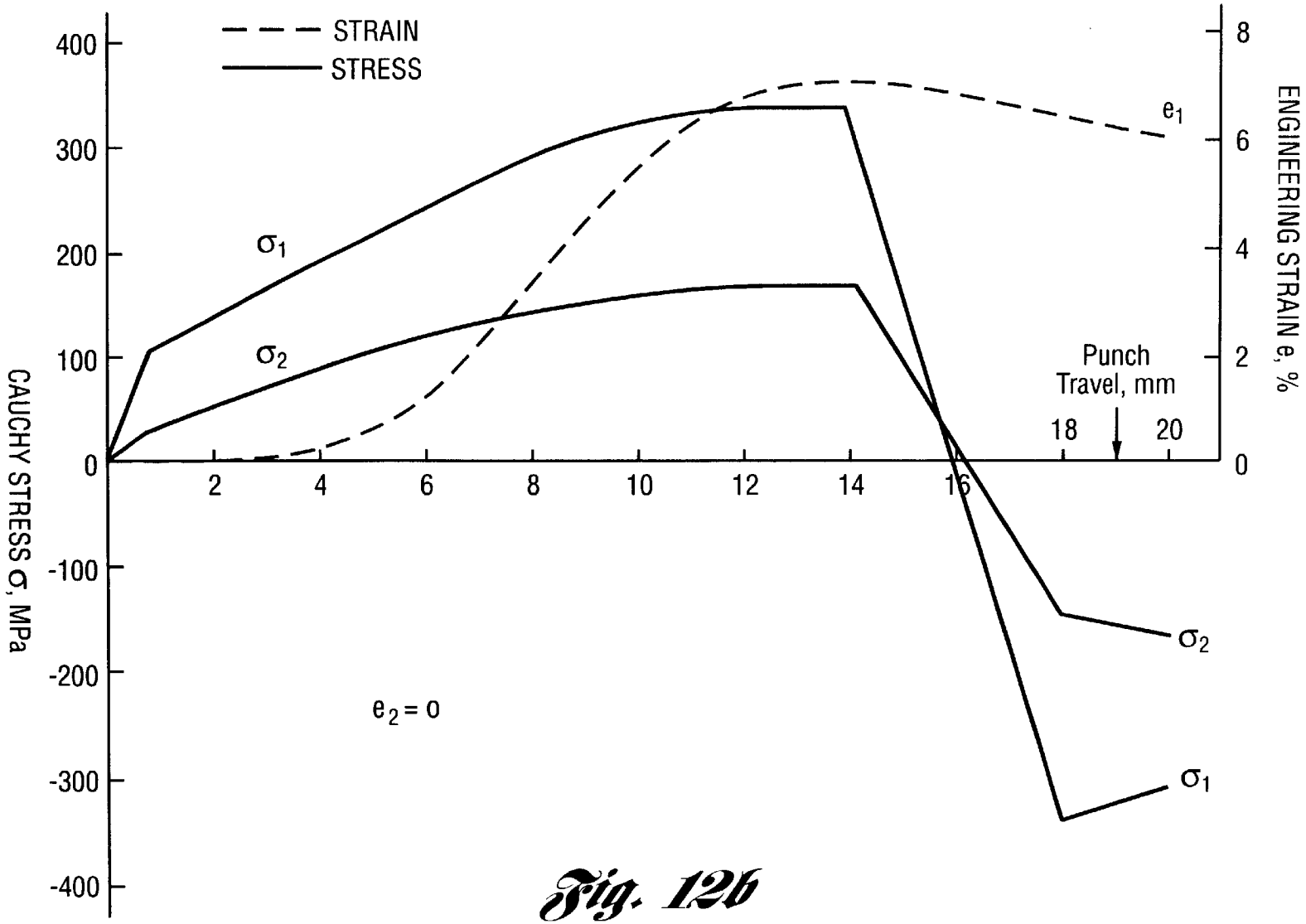
FIG. 12*b* is a graph illustrating the stress and strain history of the top surface of element 15 from the isotropic hardening rule.

Applying the present hardening rule, we have analyzed the plane strain draw. FIG. 11 shows the finite element model, final deformed shape at the punch travel of 20 mm and the thickness strain distribution. Element 15 was drawn over the die corner and then to the side wall; therefore there was bending and unbending process involved. The strain component $e_1$ at the top surface of the sheet from the present hardening rule is plotted in FIG. 11*a*. Note that $e_2$=0 because of the plane strain assumption. Unloading which was caused by unbending occurred after the punch traveled 14 mm. The stress components from the present rule are shown in the same figure. FIG. 12*b* shows the same stress and strain components from the isotropic hardening rule. There is not much difference between these two sets of strains in FIGS. 12*a* and 12*b*; however, stresses from the present hardening rule are much lower than those from the isotropic hardening rule after unloading and reloading.

An aluminum S-rail with a binder pressure of 10 KN, a benchmark of NUMISHEET 96, was used as a test of the simple method and the anisotropic hardening rule for springback analysis. FIG. 13 shows a section across the S-rail before and after springback. Test results are also plotted. FIG. 13 shows the results from using the isotropic hardening rule and the linear elastic material model for springback analysis. The test results are quite close to those from the presented anisotropic rule. The elastic material model underestimates the amount of springback, while the isotropic hardening rule makes wrong predictions.

An aluminum hood with a thickness of 1 mm was formed using an inverted stretch-draw process. Taking advantage of symmetry, only one-half of the hood was modeled. FIG. 14 shows the hood after springback. Also shown is a section along the center line of the hood before and after springback. Because this is a stretch-dominated process, very little springback is observed. In this example, we did not model the draw-beads in detail but instead replaced them by elastic-plastic springs; therefore, the actual hood could be much stiffer and the amount of spring might be even less. We did measure the deformed hood after it was released from the die. Because it was over-constrained in the test, a comparison between the computed and the measured results was not possible.

This invention thus proposes a more realistic and still mathematically simple hardening rule to compute the elastic-plastic stress-strain relationship. This rule was then implemented into a sheet metal forming analysis program. The penalty to apply the rule is that computing time would increase by 50% in comparison to that of the conventional hardening rule, also a small amount of extra computer memory is required to store the historical data of the inactive yield surfaces. Numerical examples have shown that the unrealistically high stress from the isotropic hardening rule even for a single cycle of loading and unloading process may be eliminated if this invention's hardening rule is applied instead. This unrealistically high stress might cause numerical instability in the computation.

It is understood that while the form of the invention herein shown and described constitutes the preferred embodiment of the invention, it is not intended to illustrate all possible forms thereof. It will also be understood that the words used are words of description rather than limitation, and that various changes may be made without departing from the spirit and scope of the invention as disclosed.

What is claimed is:

1. A method for predicting deformation of a sheet of metal during a draw forming process designed to form the sheet metal into a part, for use with a computer having a memory and sheet forming tools, the method comprising:

calculating the strain increment for a load step associated with loading the sheet metal in the sheet forming tools;

sub-dividing the strain increment for each load step associated with loading into a plurality of sub-intervals;

calculating the stress increment for each of the plurality of sub-intervals of strain increment associated with loading under the following Mroz's hardening rule equations:

$$f = (3/2)(s_{ij} - a_{ij})(s_{ij} - a_{ij}) - k^2 = 0 \quad (i, j = 1, 3)$$

$$(3/2)(s_{ij} - a_{ij})(ds_{ij} - da_{ij}) - kdk = 0$$

$$da_{ij} = \sqrt{2/3}\, dk b_{ij}$$

$$dk = (3/2)(s_{ij} - a_{ij}) ds_{ij} / \bar{k}$$

$$\bar{k} = k + \sqrt{3/2}\,(s_{ij} - a_{ij}) b_{ij}$$

$$da_{ij} = \sqrt{3/2}\,[(s_{mn} - a_{mn}) ds_{mn} / \bar{k}] b_{ij}$$

where f=yield surface $s_{ij}$=deviatoric components of Caunchy stress tensor σ a=a tensor to express the center of the active yield surface

√2/3 k=radius of active yield surface k=size of the yield surface b=unit tensor calculating the strain increment for a load step associated with unloading the part after formation;

sub-dividing the strain increment for each load step associated with unloading into a plurality of sub-intervals;

calculating the stress increment for each of the plurality of sub-intervals of strain increment associated with unloading under the equations for the anisotropic rule of hardening:

$$f = \frac{1+2R}{1+R}\left(r^{\alpha}_{\beta} r^{\beta}_{\alpha} - \frac{R}{1+2R} r^{\alpha}_{\alpha} r^{\beta}_{\beta}\right) - k^2 = 0$$

$$r^{\alpha}_{\beta} = \tau^{\alpha}_{\beta} - a^{\alpha}_{\beta} \quad (\alpha, \beta = 1, 2)$$

$$da^{\alpha}_{\beta} = A dk b^{\alpha}_{\beta}$$

$$da_{ij} = \sqrt{3/2}\,[(s_{mn} - a_{mn}) ds_{mn} / \bar{k}] b_{ij}$$

$$dk = \frac{1+2R}{1+R}\left(r^{\alpha}_{\beta} d\tau^{\beta}_{\alpha} - \frac{R}{1+2R} r^{\alpha}_{\alpha} d\tau^{\beta}_{\beta}\right) \Big/ \bar{k}$$

$$\bar{k} = k + A\frac{1+2R}{1+R}\left(r^{\alpha}_{\beta} b^{\beta}_{\alpha} - \frac{R}{1+R} r^{\alpha}_{\alpha} b^{\beta}_{\beta}\right)$$

where b=unit tensor

A=A scalar a=a tensor to express the center of the active yield surface k=size of the yield surface

α,β=1, 2 f=yield surface

R=a material parameter expressing the transversely anisotropic property of the sheet calculating the strain increment for a load step associated with reloading the sheet in the sheet forming tools;

sub-dividing the strain increment for each load step associated with reloading into a plurality of sub-intervals; and calculating the stress increment associated for each of the plurality of sub-intervals of strain increment associated with reloading under Mroz's hardening rule equations.

2. The method of claim 1, further comprising storing the center of the yield surface and yield surface size in the computer's memory when the change of stress is less than zero and after unloading is detected.

3. The method of claim 2, further comprising: setting the load step at the stored yield surface size.

4. The method of claim 2, further comprising determining whether the yield surface size is larger than the stored yield surface size and using the stored center of the yield surface when the yield surface is larger than the stored yield surface size and reloading is detected.

5. The method of claim 1, further comprising sub-dividing the strain increment for each load step associated with loading into 150–250 sub-intervals.

6. The method of claim 1, further comprising sub-dividing the strain increment for each load step associated with loading into 200 sub-intervals.

7. The method of claim 1, further comprising sub-dividing the strain increment for each load step associated with unloading into at least five sub-intervals.

8. The method of claim 1, further comprising sub-dividing the strain increment for each load step associated with reloading into 150–250 sub-intervals.

9. The method of claim 1, further comprising-sub-dividing the strain increment for each load step associated with reloading into 200 sub-intervals.

10. A method for predicting deformation of a sheet of metal during a draw forming process to form the sheet metal into a part and sheet metal forming tools, the method comprising:

calculating the strain increment for a load step associated with loading the sheet metal in the sheet metal forming tools;

sub-dividing the strain increment for each load step associated with loading into a plurality of sub-intervals;

calculating the stress increment for each of the plurality of sub-intervals of strain increment associated with loading under the following Mroz's hardening rule equations:

$$f = (3/2)(s_{ij} - a_{ij})(s_{ij} - a_{ij}) - k^2 = 0 \quad (i, j = 1, 3)$$

$$(3/2)(s_{ij} - a_{ij})(ds_{ij} - da_{ij}) - kdk = 0$$

$$da_{ij} = \sqrt{2/3}\, dk b_{ij}$$

$$dk = (3/2)(s_{ij} - a_{ij}) ds_{ij} / \bar{k}$$

$$\bar{k} = k + \sqrt{3/2}\,(s_{ij} - a_{ij}) b_{ij}$$

$$da_{ij} = \sqrt{3/2}\,[(s_{mn} - a_{mn}) ds_{mn} / \bar{k}] b_{ij}$$

where f=yield surface $s_{ij}$=deviatoric components of Caunchy stress tensor σ a=position tensor of the center of the active yield surface

√2/3 k=radius of active yield surface k=size of yield surface b=unit tensor calculating the strain increment for a load step associated with unloading the part after formation;

sub-dividing the strain increment for each load step associated with unloading into a plurality of sub-intervals;

calculating the stress increment based on the strain increment for each load step associated with unloading under the equations for the anisotropic rule of hardening:

$$f = \frac{1+2R}{1+R}\left(r^{\alpha}_{\beta}r^{\beta}_{\alpha} - \frac{R}{1+2R}r^{\alpha}_{\alpha}r^{\beta}_{\beta}\right) - k^2 = 0$$

$$r^{\alpha}_{\beta} = \tau^{\alpha}_{\beta} - a^{\alpha}_{\beta} \quad (\alpha, \beta = 1, 2)$$

$$d a^{\alpha}_{\beta} = A d k b^{\alpha}_{\beta}$$

$$d a_{ij} = \sqrt{3/2}\,[(s_{mn} - a_{mn}) d s_{mn} / \bar{k}] b_{ij}$$

$$d k = \frac{1+2R}{1+R}\left(r^{\alpha}_{\beta} d \tau^{\beta}_{\alpha} - \frac{R}{1+2R} r^{\alpha}_{\alpha} d \tau^{\beta}_{\beta}\right) \Big/ \bar{k}$$

$$\bar{k} = k + A\frac{1+2R}{1+R}\left(r^{\alpha}_{\beta} b^{\beta}_{\alpha} - \frac{R}{1+R} r^{\alpha}_{\alpha} b^{\beta}_{\beta}\right)$$

where b=unit tensor

A=A scalar a=a tensor to express the center of the active yield surface k=size of the yield surface

α,β=1, 2 f=yield surface

R=a material parameter expressing the transversely anisotropic property of the sheet storing the center of the yield surface and the yield surface size in the computer's memory when the change of stress is less than zero and after unloading is detected;

setting the load step at the stored yield surface size;

calculating the strain increment for a load step associated with reloading the sheet in the sheet metal forming tools;

sub-dividing the stress increment for each load step associated with reloading into a plurality of sub-intervals;

determining whether the yield surface size is larger than the stored yield surface size;

using the stored center of the yield surface when the yield surface is larger than the stored yield surface size and reloading is detected; and calculating the stress increment associated for each of the plurality of sub-intervals of strain increment associated with reloading under Mroz's hardening rule equations.

11. A method for aiding sheet metal forming tool design, for use with a computer including memory and forming tools including a draw die, punch and binder with a draw-bead, the forming tools having surfaces designed to form the sheet metal into a part, the sheet metal being represented as a mesh including a plurality of nodes, the sheet metal mesh also including at least one spring node located at a boundary of the sheet metal, the method comprising the steps of:

numerically determining by the computer the sheet metal mesh nodes contacting the punch and die tool surfaces due to the punch advancing to form the part and applying a position displacement increment to the nodes;

determining by the computer a strain and stress distribution in the sheet metal due to unloading the part from the forming tools under the following equations for the anisotropic hardening rule:

$$f = \frac{1+2R}{1+R}\left(r^{\alpha}_{\beta}r^{\beta}_{\alpha} - \frac{R}{1+2R}r^{\alpha}_{\alpha}r^{\beta}_{\beta}\right) - k^2 = 0$$

$$r^{\alpha}_{\beta} = \tau^{\alpha}_{\beta} - a^{\alpha}_{\beta} \quad (\alpha, \beta = 1, 2)$$

$$d a^{\alpha}_{\beta} = A d k b^{\alpha}_{\beta}$$

$$d a_{ij} = \sqrt{3/2}\,[(s_{mn} - a_{mn}) d s_{mn} / \bar{k}] b_{ij}$$

$$d k = \frac{1+2R}{1+R}\left(r^{\alpha}_{\beta} d \tau^{\beta}_{\alpha} - \frac{R}{1+2R} r^{\alpha}_{\alpha} d \tau^{\beta}_{\beta}\right) \Big/ \bar{k}$$

$$\bar{k} = k + A\frac{1+2R}{1+R}\left(r^{\alpha}_{\beta} b^{\beta}_{\alpha} - \frac{R}{1+R} r^{\alpha}_{\alpha} b^{\beta}_{\beta}\right)$$

where b=unit tensor

A=A scalar a=a tensor to express the center of the active yield surface k=size of the yield surface

α,β=1, 2 f=yield surface

R=a material parameter expressing the transversely anisotropic property of the sheet; and reconstructing at least one of the tool surfaces based on the strain and stress distribution, so as to prevent part failures from distribution due to springback.

* * * * *